US011866906B2

(12) United States Patent
Falkenhagen

(10) Patent No.: US 11,866,906 B2
(45) Date of Patent: Jan. 9, 2024

(54) HOLLOW BORING AUGER

(71) Applicant: Eric Alan Falkenhagen, Cairns (AU)

(72) Inventor: Eric Alan Falkenhagen, Mena Creek (AU)

( * ) Notice: Subject to any disclaimer, the term of this patent is extended or adjusted under 35 U.S.C. 154(b) by 421 days.

(21) Appl. No.: 15/562,464

(22) PCT Filed: Mar. 24, 2016

(86) PCT No.: PCT/AU2016/050229

§ 371 (c)(1),
(2) Date: Sep. 28, 2017

(87) PCT Pub. No.: WO2016/154669

PCT Pub. Date: Oct. 6, 2016

(65) Prior Publication Data

US 2018/0087238 A1 Mar. 29, 2018

(30) Foreign Application Priority Data

Mar. 28, 2015 (AU) ..... 2015901126

(51) Int. Cl.
*E02F 5/04* (2006.01)
*E02F 3/02* (2006.01)
(Continued)

(52) U.S. Cl.
CPC ..... *E02F 5/04* (2013.01); *E02F 3/02* (2013.01); *E02F 3/06* (2013.01); *E04H 12/34* (2013.01);
(Continued)

(58) Field of Classification Search
CPC .. E21B 7/005; E21B 7/027; E02F 5/04; E02F 3/02; E02F 3/06; E04H 12/34
See application file for complete search history.

(56) References Cited

U.S. PATENT DOCUMENTS 3,474,872 A * 10/1969 Danuser ..... E21B 7/028 173/147
3,506,075 A * 4/1970 Attebo ..... E21B 19/20 175/85
(Continued)

FOREIGN PATENT DOCUMENTS

AU 1661092 B1 11/1992
WO 1993006311 A1 4/1993
WO WO-9306311 A1 * 4/1993 ..... E02F 3/384

OTHER PUBLICATIONS

Supplementary Search Report dated Mar. 6, 2018, in connection with European Patent Application No. 16771090.4, 4 pgs.
(Continued)

*Primary Examiner* — Tara Schimpf
*Assistant Examiner* — Neel Girish Patel
(74) *Attorney, Agent, or Firm* — Tredecim LLC; Sean L. Sweeney

(57) ABSTRACT

The present invention relates to a hollow boring auger for use for poles, including a first and second mounting part moveably connected, one to the other, to substantially encircle the pole. A first and second auger part are also included, correspondingly attachable to the first and second mounting part, to substantially encircle the pole, A rotation apparatus associated with the mounting parts and the auger parts is included such that in use the auger parts can be rotated about the pole to bore a hollow trench about the pole. The invention also relates to a method of use.

17 Claims, 4 Drawing Sheets

(51) Int. Cl.

| | |
|---|---|
| ***E04H 12/34*** | (2006.01) |
| ***E02F 3/06*** | (2006.01) |
| ***E21B 7/00*** | (2006.01) |
| ***E21B 7/02*** | (2006.01) |

(52) U.S. Cl.
CPC ..... *E21B 7/005* (2013.01); *E21B 7/027* (2013.01); *E21B 7/028* (2013.01)

(56) References Cited

U.S. PATENT DOCUMENTS 3,589,039 A * 6/1971 Korenek ..... E02F 5/003 294/50.8
3,595,182 A * 7/1971 Clapp ..... B27K 3/0235 422/292
3,719,240 A * 3/1973 Young et al. ..... E21B 19/20 175/207
4,697,649 A * 10/1987 Kinnan ..... E02D 5/60 175/323
5,099,986 A * 3/1992 Kuzub ..... B65G 33/16 198/666
5,450,912 A * 9/1995 Cahill ..... E21B 7/28 414/733
8,910,400 B1 * 12/2014 Provines ..... A01B 33/106 175/203
2012/0181047 A1 * 7/2012 Sugden ..... E21B 19/163 166/380
2012/0298021 A1 * 11/2012 Philips ..... A01C 23/002 239/722
2012/0305233 A1 * 12/2012 In ..... E21B 19/155 166/77.51
2013/0233625 A1 * 9/2013 Robinson ..... E21B 7/027 175/203
2013/0327159 A1 * 12/2013 Russell ..... G01N 1/08 73/863.01
2015/0176337 A1 * 6/2015 Ditillo ..... E21B 7/005 175/84

OTHER PUBLICATIONS

Communication pursuant to Article 94(3) EPC dated May 15, 2018, in connection with European Patent Application No. 16771090.4, 6 pgs.

* cited by examiner

HOLLOW BORING AUGER

FIELD OF THE INVENTION

The present invention relates to a hollow boring auger, and in particular to a hollow boring auger for use to excavate around power poles, to enable inspection.

BACKGROUND OF THE INVENTION

There are millions of power poles around the world, used to support domestic power services and other wired utility services, such as telephone. The integrity of these utility and power poles is paramount, any failure could lead to the pole failing and falling causing an accident and loss of services. In a cyclone or storm the risk is dramatically increased and compounded by the strong winds causing further damage once the pole is on the ground.

The dangers of loss of structural integrity, such as of wooden poles, leads many utility companies to have the poles checked regularly, though a diarised system. In this way the poles that are considered likely to fail in the short term can be is replaced instead, which improves safety, reduces costs and of course minimises power outages to consumers. If a pole was to fail, the power outage time is likely to be significant as a callout must be made and suitable technicians, equipment and a new pole must be obtained. In regional area, technicians, equipment and new poles may need to be obtained from the State capital which leads to further delays, increased costs to the utility company and delays and loss of service to the customer, which is undesirable. It is difficult for most businesses to operate without power and so there is a significant loss of productivity after storm activity where power is lost due to pole failure.

A power pole may fail if the pole is damaged, losing integrity, such as at the base, in particular. Damage at the base of the pole will lead to the pole to be prone to falling and damaging the power lines, leading to power outages and potentially injury or death to anybody in the vicinity at the time.

Damage at the base of the pole often occurs beneath the surface, which cannot be readily be inspected. The part of the pole under the ground may become soft due to the action of damp and rot, or termites, for example. If the base of the pole becomes soft and loses integrity below the ground this is a potentially very dangerous situation that may not be discernible unless a specific inspection of below the ground is carried out. Typically a worker will need to dig carefully around the base of the pole to remove soil so that the base of the pole can be inspected visually and tested for integrity. Through use of the subject invention a precise hollow can be bored around the base of the pole, at minimal effort, to enable this vital safety inspection. The predetermined measurements of the subject inventive hollow boring auger ensure a neat hole is dug, sufficient to allow inspection but no more, so minimal effort, time cost and disturbance to people in the neighbourhood—an excellent outcome. The utility company and contracted worker, checking the pole will save time and money in both the digging of the inspection pit and also the reduced time and effort of backfilling the hole afterwards.

The inventor has through many years of careful research and development worked on a clever new invention, for a hollow boring auger with an automated rotating drive mechanism, as disclosed for the first time in the subject application. The inventor has developed an impressive drive system to automate the digging of the hollow around the pole to allow ready inspection. There are numerous further advantageous and beneficial features of the invention, such as the opening and closing mechanism, new bearing system and the collar support. The application of the invention is likely to be significant improvement over the art and become the standard, once implemented. It is hoped that use of the invention will vastly improve the efficiency of pole inspections and other similar tasks.

The following describes a non-limiting example of the invention being used with reference to excavating around a power pole so that the base of the power pole can be inspected for rot, termites or other loss of integrity which may lead to the power pole needing to be replaced. The particular use of the invention described for use with power poles is a particularly useful one, and with a huge potential market. However, the invention described herein is not intended to be restricted to use with power poles but may be used to inspect any suitable pole bases. Further the invention could be used for other purposes or with other equipment, for example, back hoes, telescopic handlers or similar devices that have the hydraulic capacity suitable to operate the invention, as described further below. There is a further application for use of the auger for use with palm trees and other nursery applications. It is not intended that the invention be limited to use with power poles, except where specified in the claims.

For clarity, any prior art referred to herein, does not constitute an admission that the prior art forms part of the common general knowledge, in Australia or elsewhere.

It is an object of the present invention to provide a hollow boring auger that at least ameliorates one or more of the aforementioned problems of the prior art.

DISCLOSURE OF THE INVENTION

Accordingly, the present invention provides a hollow boring auger for use for poles, the hollow boring auger including:

- a first mounting part and a second mounting part, moveably connected, one to the other, to substantially encircle the pole;
- a first auger part and a second auger part, correspondingly attachable to the first mounting part and second mounting part, to substantially encircle the pole; and
- a rotation apparatus associated with the mounting parts and the auger parts such that the auger parts can be rotated about the pole to bore a hole, wherein, on operation of the rotation apparatus the auger parts are caused to bore a hollow trench.

Preferably, the hollow boring auger is for digging a hollow trench around a pole. The hollow boring auger may be used for any suitable purpose.

The pole may be any suitable pole or post. The pole may be a wooden pole. The pole may be a power pole for use for electricity wires. The pole may be a pole used for provision of utility services. The utility services may be power, telephone or other wired services. The hollow boring auger may be used for any suitable application. The hollow boring auger may be used in the nursery industry. The pole or post may be a palm tree and the hollow boring auger is used to assist to excavate the palm. The pole may be any tree.

The first and second mounting parts may take any suitable shape. Preferably, the first and second mounting parts can move between an open and closed state. In the open state the pole can pass so as to be within the first and second mounting parts. Preferably, in the closed state the first and second mounting parts substantially define an aperture.

Preferably, the first and second mounting parts are configured to substantially encircle or surround the pole, in the closed state. Preferably, the aperture is configured to be of a similar shape and size to the pole to be encircled. Preferably, the pole is substantially circular in cross-section and the aperture is a similar circular shape in cross-section. For other applications or shapes of pole the aperture may be any suitable shape.

The first mounting part and second mounting part preferably include "mirror images" parts to define the aperture. In a preferred form of the invention, each of the first mounting part and the second mounting part include a semi-circular part which when the first mounting part and second mounting part are moved together forms a circular aperture suitable for receipt of the pole. Preferably, the circular aperture is dimensioned to be substantially the same as the cross-sectional dimensions of the pole.

The outer shape of the first mounting part and the second mounting part may be the same or different to one another. The general perimeter shape of the first mounting part and the second mounting part when in a closed state may be square. Clearly, other suitable shapes may be used instead, such as to include attachment points.

Preferably, the first mounting part and the second mounting part are moveable between an open and a closed state. The first mounting part and the second mounting part may be hinged or pivoted together. Any suitable attachment may be used between the first mounting part and the second mounting part. The moveable connection may take any suitable form. Hinging or pivoting of first mounting part and second mounting part is particularly suitable as it enables a smooth movement between the open and closed state. Alternatively, in an inferior form of the invention the first and second mounting parts may be fitted together before use.

Preferably, the encircling is to closely surround the circular perimeter of the pole. Most preferably, the encircling is to very closely encircle the pole.

In one particularly preferred form of the invention, the first mounting part and the second mounting part are hinged together to form "jaws" which can be moved to proximally the base of a pole or post and closed around the pole. The movement of the jaws is preferably hydraulically controlled. Most preferably, in this way the "jaws" can readily fit around the base of the pole in use before the digging of the hole.

Preferably, the first mounting part and the second mounting part are attached to a hydraulics system. Preferably, the hydraulics system is the hydraulics system of an attached vehicle. In other forms of the invention any suitable drive mechanism may be used to move the first mounting part and the second mounting part between the closed and open state. For example, a battery powered actuator or other electrical system could be used instead. Most preferably, the opening and closing of the first mounting part and the second mounting part is controlled from the cabin of the attached vehicle. The controlling of the opening and closing is preferably through use of the hydraulics, whereby the "jaws" can be opened and closed readily by the operator from the cabin of the associated vehicle.

In a preferred form of the invention the first mounting part may include a part for attachment to a vehicle. The part for attachment may be a boom or strut. The boom or strut may be part of the vehicle. The boom or strut may form part of the apparatus in other forms. The boom or strut may be a standard boom of a hydraulic digger enabling attachment of the hydraulics to the apparatus to drive the rotation apparatus. The vehicle may be any suitable vehicle. The vehicle may be a digger, prime mover, excavator, telescopic handler or back hoe, for example. Preferably, the vehicle includes a hydraulics system used to operate the hollow boring auger.

Preferably, the first mounting part and the second mounting part each include a collar, configured to substantially encircle the pole in the closed state in use. Preferably, in the closed state the collar forms a cylinder that extends to at least some extend along the length of the pole. Preferably, the collar extends at least 250 millimetres along the length of the pole. The extension may be any suitable length. Preferably, the collars form a support collar to act against destabilisation of the pole while the hole is being dug around the base. A plurality of parts may be used instead of the pair of mounting parts, in another form of the invention.

The first mounting part and second mounting part are preferably made of a strong metal material. Other materials may be used alternatively for the mounting parts. Preferably, the first and second mounting parts are made of a strong steel material.

The first auger part and the second auger part, preferably, together form an auger for digging a hollow around the base of the pole. Preferably, the first auger part and the second auger part together create a spiral drill. The spiral drill may include a back plate and a blade formed to be continuous when the first auger part and the second auger part are put together. Preferably, a cutting edge is included at the end of the blade to facilitate the cutting of the blade into the ground. The first auger part and second auger may take other forms, suitable to for making a hollow bore. The first auger part and the second auger part may take any suitable form to dig or bore a hole.

The first and second auger parts may take any suitable shape. Preferably, the first and second auger parts can move between an open and closed state. Preferably, the first and second auger parts can move between an open and closed state with the first and second mounting parts. In the open state the pole can pass so as to be within the first and second auger parts. Preferably, in the closed state the first and second mounting auger substantially define a cylinder, generally corresponding to the pole. Preferably, the first and second mounting auger are configured to substantially surround the pole, in the closed state. Preferably, the cylinder is configured to be of a similar shape and size to a second of the pole to be encircled. Preferably, the pole is substantially circular in cross-section and the cylinder is of a similar circular shape in cross-section. For other applications or shapes of pole the cylinder may be any suitable shape.

The first auger part and second auger part preferably include "mirror images" parts to define the cylinder. In a preferred form of the invention, each of the first mounting auger and the second auger part include a semi-cylindrical part which when moved together forms a cylinder suitable to substantially surround the pole. In this way the pole is protected from damage during use.

The first auger part preferably corresponds to the first mounting part, and the second auger part corresponds to the second mounting part so as to be attachable thereto. In another form of the invention the attachment of the various parts may be reversed as would be understood by a person skilled in the art. The general cross-sectional profile of the first auger part preferably corresponds to that of the first mounting part and similarly the second auger part preferably corresponds to that of the second mounting part.

Preferably, the first auger part is attached to the first mounting part and the second auger part is attached to the second mounting part before use. The attachment may be any suitable attachment. Preferably, a nut and bolt arrangement is used to attach the parts together. Attachment plates may be used to attach the parts together. Preferably, a pair of attachment plates are included configured to correspond generally, when closed together, to the shape of the pole in cross-section. Preferably, a pair of attachment plates are included to attach each between the first mounting part and the first auger part and separately, the second mounting part and the second auger part. Preferably, nut and bolt arrangements are used. Any suitable fixings may be used. Preferably, the pair of attachment plates are substantially semi-circular. Preferably, a semi-circular attachment plate is attached between the corresponding first mounting part and the first auger part and a second semi-circular attachment plate is attached between the corresponding second mounting plate and the second auger part, and once attached the opening and closing of these parts is together, so as to create "jaws" which can be closed about the base of the pole.

Preferably, once the first mounting part and the first auger part and separately, the second mounting part and the second auger part, are attached together they will open and close together. Preferably, once attached together moving between the open and closed state of the first mounting part and second mounting part will also open and close the first auger part and the second auger part together. Preferably, together the first and second mounting parts provide the mechanism to open and close, which also opens and close the attached first auger part and the second auger part. Preferably, the opening and closing of the attached first and second mounting parts and the first and second auger parts is by means of hydraulic rams controlled from an attached vehicle.

Preferably, the encircling of the first auger part and second auger part is to closely surround the base of the pole.

In another form of the invention the first auger part is permanently attached to the first mounting part and the second auger part is permanently attached to the second mounting part. There are disadvantages to this permanent form of the invention in that there is no ability to vary the size of auger to be used and hence the size of the hole to be dug as discussed further below.

Optionally, in another form of the invention, the first mounting part and second mounting part may be formed independently of the first auger part and the second auger part but are moved together during use, so that the rotation apparatus can be utilised between them to rotate the auger parts.

The first auger part and the second auger part may be made of any suitable material. Preferably, the first auger part and the second auger part are made of a strong metal material. The strong metal material may be steel. A plurality of parts may be used instead of the pair of auger parts, in another form of the invention.

Preferably, the rotation apparatus is adapted to rotate the first and second auger parts to dig a trench. Preferably, the trench is dug about the pole. The rotation apparatus may take any suitable form. Preferably, the rotation apparatus lies between the first and second mounting parts and the first and second auger parts. Preferably, the rotation apparatus is adapted to be in part associated with the first and second mounting part and another part associated with the first and second auger part. Most preferably, the rotation apparatus included composite bearing arrangements adapted to enable rotation of the first auger part and the second auger parts together, to dig a hole. An auger is created by the closed jaws about the pole, which on rotation digs the hollow without damaging the pole.

The composite bearings may take any suitable form to enable rotation of the spiral drill formed by the first and second auger parts. A "slipper bearing" arrangement may be used. The parts of the composite bearing associated with the mounting parts and separately the auger parts may be completed by a new plastic or oil impregnated bearing "slipper bearing" which is attached to the attachment plates. In one preferred form of the invention sprockets are included which move an associate chain on rotation which in turn causes rotation of at least one of the first and second auger parts.

Preferably, a composite bearing arrangement is included between the first mounting part and the first auger part, the composite bearing arrangement including a pair or sprockets within a chain arranged so that rotation of at least one of the sprockets translates to rotation of the chain, which in turn is translated to rotation of the first auger part by a cooperating portion on the first auger part. Preferably, the cooperating portion is a toothed portion on the first auger part that is caused to rotate due to cooperation with the proximal section of chain, when it is also rotating. The toothed portion and chain may be replaced by other forms of cooperation to translate to rotation of the first auger part. The direction of the rotation is dictated by the rotation direction of the sprocket. Preferably, there is a second sprocket, and the first and second sprocket define the outer perimeter of the opening for the pole.

Preferably, a composite bearing arrangement is included between the second mounting part and the second auger part, the composite bearing arrangement including a pair or sprockets within a chain arranged so that rotation of at least one of the sprockets translates to rotation of the chain, which in turn is translated to rotation of the second auger part by a cooperating portion on the second auger part. Preferably, the cooperating portion is a toothed portion on the second auger part that is caused to rotate due to cooperation with the proximal section of chain, when it is also rotating. The toothed portion and chain may be replaced by other forms of cooperation to translate to rotation of the second auger part. The direction of the rotation is dictated by the rotation direction of the sprocket. Preferably, there is a second sprocket, and the first and second sprocket define the outer perimeter of the opening for the pole, between the second mounting part and second auger part.

Preferably, the rotating apparatus includes one or more hydraulic motors. Preferably, the first sprockets of each of the halves of the device are driven by a hydraulic motor. Preferably, the hydraulic motor is mounted to the first or second mounting part, proximal to the corresponding sprocket. Preferably, a hydraulic motor is mounted above the first sprockets to cause rotation of the first sprockets in a chosen direction. Preferably, control of the hydraulic motors is from the hydraulic system of the associated vehicle. Preferably, the hydraulic motor is controlled from the cabin of the vehicle. Idler gears may be included within the chain to assist free movement of the chain.

Preferably, a pair or hydraulic motors are included. Preferably, the rotation apparatus is configured so that operation of the hydraulic motors together causes the corresponding auger parts to rotate whereby a spiral drill is created from the two parts. Preferably, as the hydraulic motors are operated the corresponding sprockets rotate so as to rotate the chains between the pair of sprockets associated with that chain, causing the associated coordinating part of the auger part to rotate together with the other auger part, whereby the pair or auger parts rotate together to bore a hollow trench. Preferably, the one or more hydraulic motors are controlled by the hydraulics of the vehicle with which the hollow boring auger is used. Preferably, the hydraulic motors can be controlled to turn on, off and to change the speed of operation.

One or more parts of the composite bearings may be attached to the attachment plates, rather than to the mounting parts or auger parts directly. Preferably, the mounting parts for a frame for attachment of the drive mechanism of the vehicle and the auger parts rotate within the frame, in use.

Preferably, a trench is dug around the base of the pole by the auger so that there is minimum effort and disturbance to the surrounding ground.

Preferably, the first mounting plate and the second mounting plate may be used with more than one size of first and second auger parts. In this way a single apparatus may be used for digging holes of different diameters, a great advantage over the prior art. The first and second auger parts suitable for digging a hole or trench of a particular size can be attached directly to the first and second mounting part, Or the first and second auger parts are preferably attached to corresponding attachment plates which in turn are attached to the first and second mounting parts so that the attached parts can be closed about a pole before use. Most preferably, a number of auger parts may be supplied for use for digging different hollow trenches which all can be attached to the same "frame" formed of the first and second mounting parts.

Companion plates may be used to vary the width or length of the apparatus and vary the size of the trench to be dug. Preferably, the companion plates may be attached to the mounting plates and or auger parts.

Accordingly, the present invention also provides a hollow boring auger for use for poles, the hollow boring auger including:

- a first mounting part and a second mounting part, moveably connected, one to the other, to substantially encircle the pole;
- a variety of first auger part and second auger parts, correspondingly attachable to the first mounting part and second mounting part, to substantially encircle the pole of a size matched to the particular first auger part and second auger part attached; and
- a rotation apparatus associated with the mounting parts and the auger parts such that the auger parts can be rotated about the pole to bore a hole, wherein, on operation of the rotation apparatus the auger parts are caused to bore a hollow trench, about the base of the pole.

Accordingly, the invention also provides a method of use of a hollow boring auger for use with a pole, the hollow boring auger including a first mounting part and second mounting part attached correspondingly to a first auger part and a second auger part with a moveable attachment, with a rotation apparatus associated between them so that the auger parts can be rotated, the method including the following steps:

a) positioning the attached first mounting part and first auger part and second mounting part and second auger part close to the base of the pole;

b) closing the "jaws" created by the first mounting part, first auger part, and the moveably attached second mounting part and second auger part, about the base of the pole;

operating the rotation apparatus whereby the first and second auger parts rotate to create a hollow trench about the base of the pole.

Throughout the above, where the use is not related to a pole, another item may be substituted so a hollow trench can be dug thereabout. The hollow boring auger of the method may be the hollow boring auger of the invention in any of its forms or variations.

INDUSTRIAL APPLICABILITY

The hollow boring auger of the invention will be manufactured industrially, assembled and supplied to companies for use with poles, posts and trees.

BRIEF DESCRIPTION OF THE DRAWINGS

The invention will now be described in connection with a non-limiting preferred embodiment with reference to the accompanying drawings, in which.

DETAILED DESCRIPTION OF THE INVENTION, INCLUDING A BEST MODE

Figure 1:
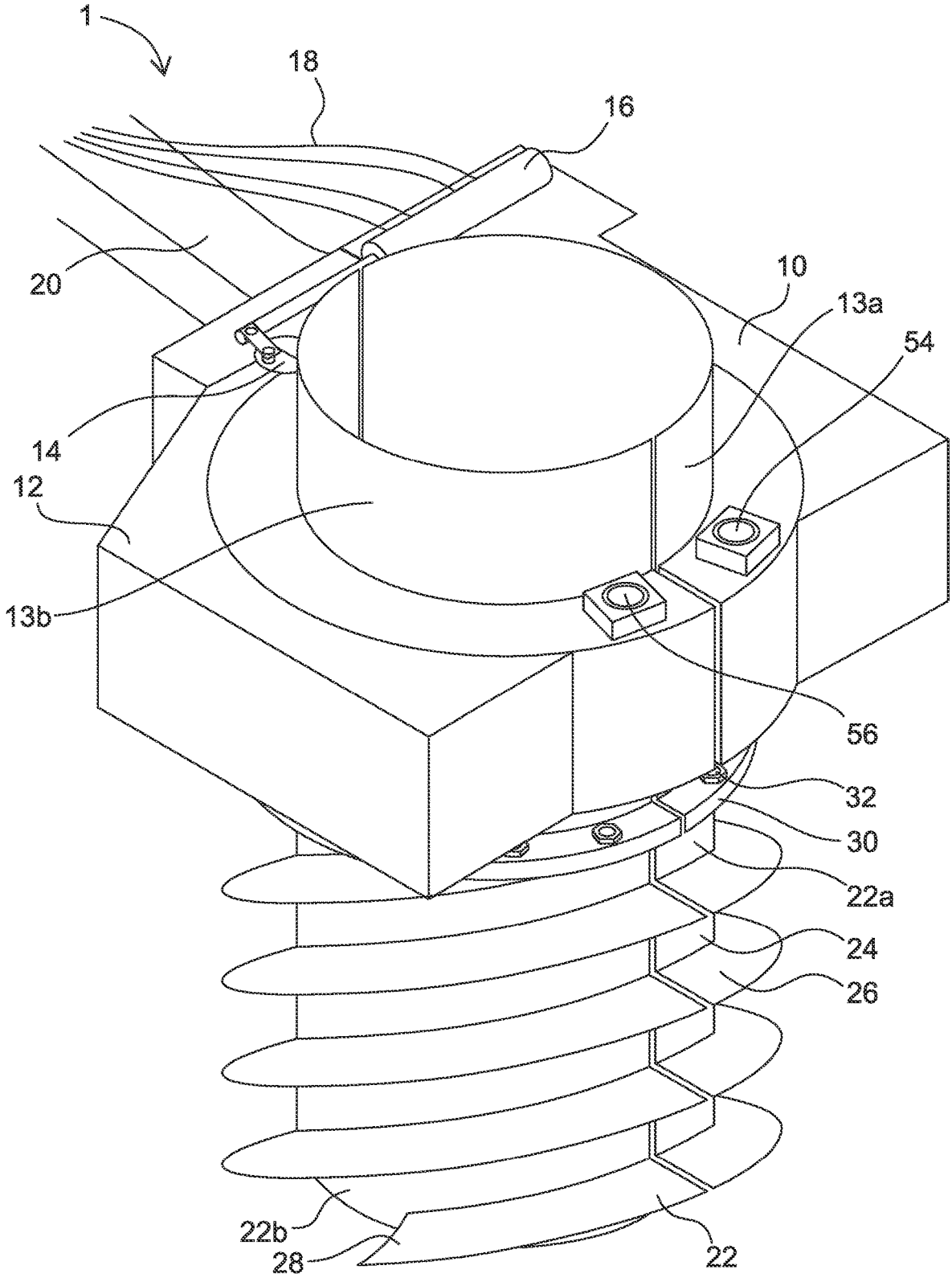
FIG. 1 is a perspective view from above of a hollow boring auger according to a preferred embodiment of the invention as would, in use, surround a power pole and be attached to the hydraulic system of a vehicle, such as digger, or telescopic handler, however the power pole and vehicle are omitted for ease of illustration.
Figure 2:
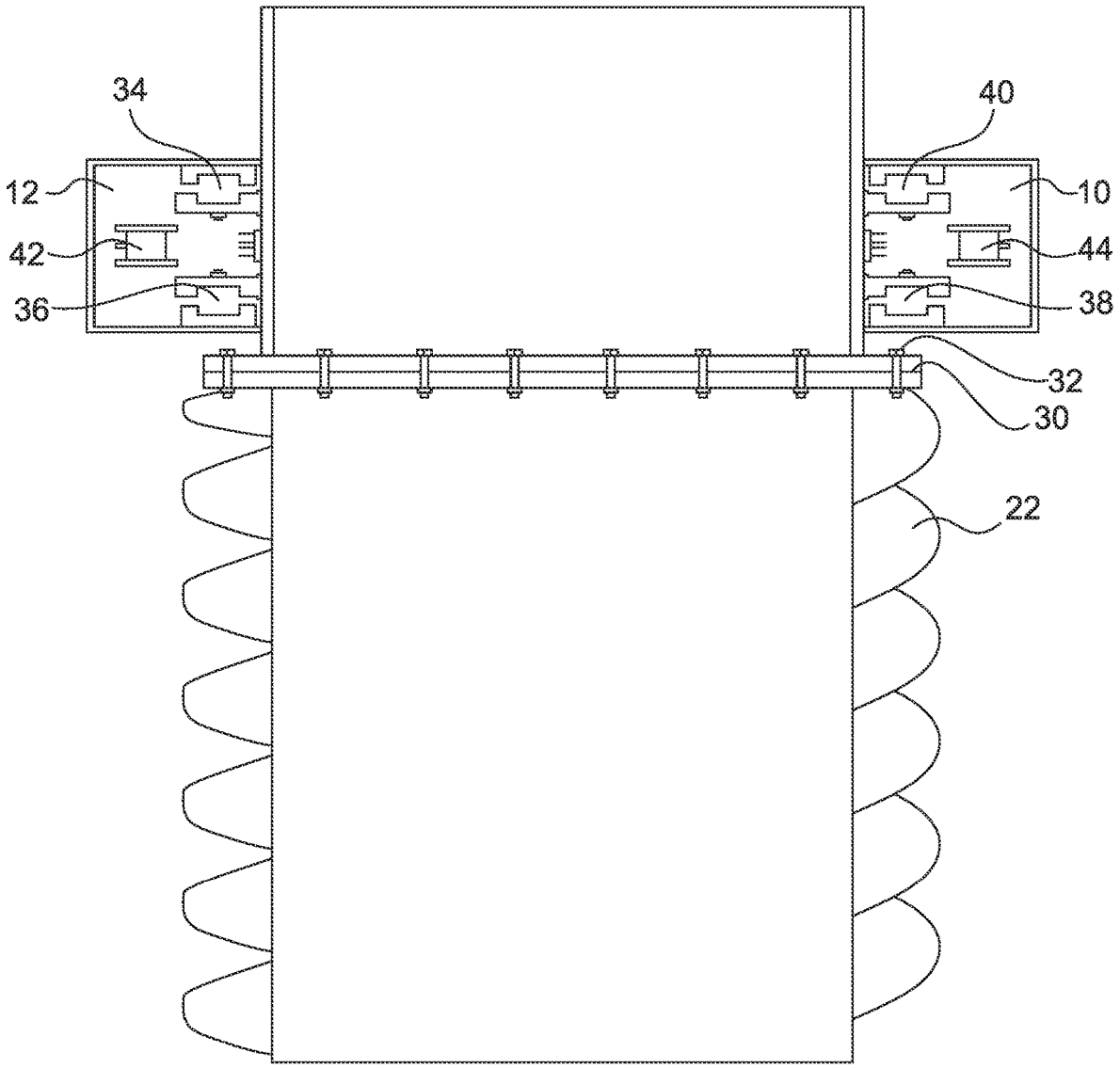
FIG. 2 is a cross-sectional view of the hollow boring auger of FIG. 1, again with the hydraulics of the drive mechanism from the vehicle and the pole itself omitted for clarity of illustration.
Figure 3:
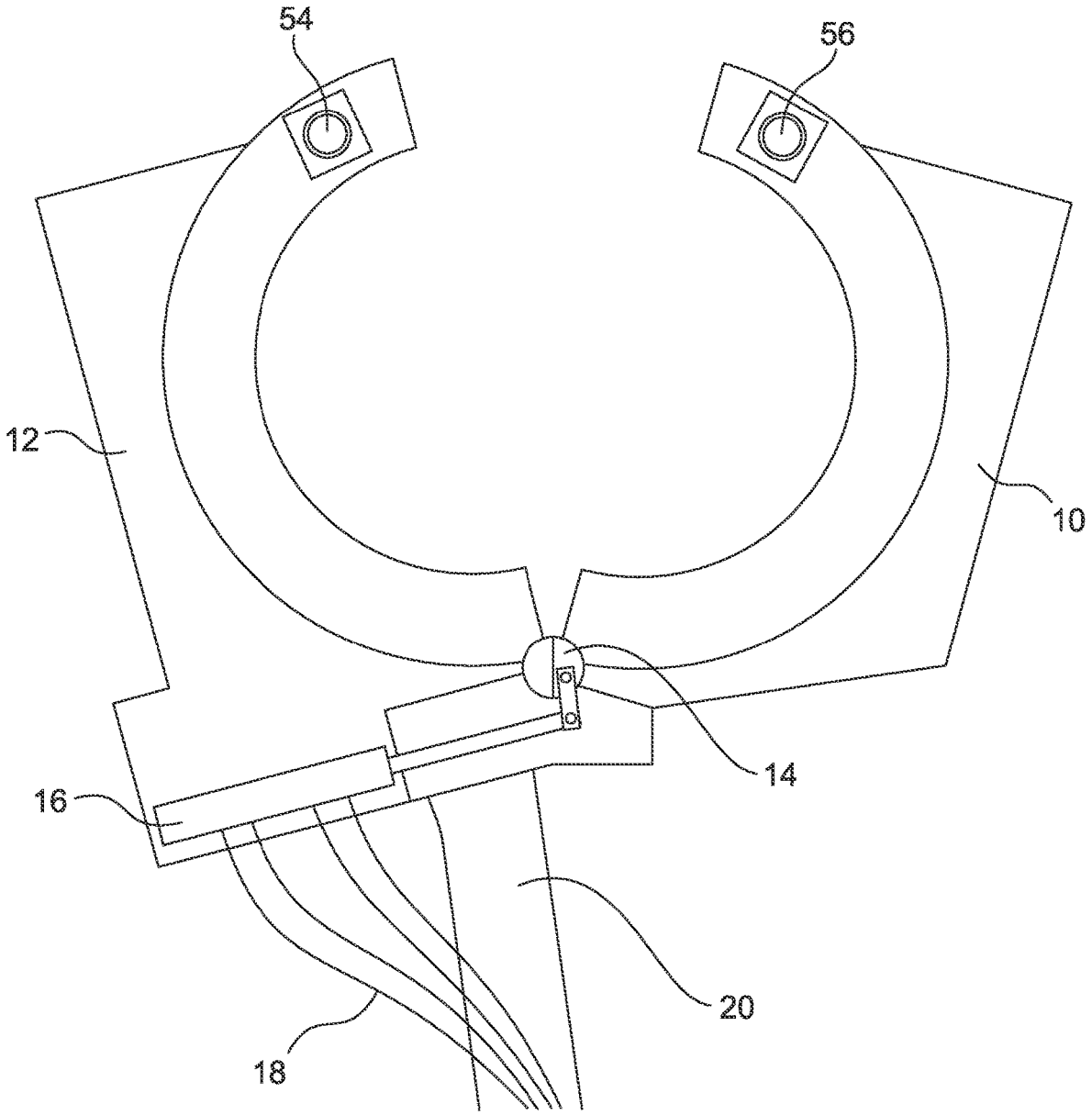
FIG. 3 is a view from above of the hollow boring auger of FIGS. 1 and 2 in an open state.
Figure 4:
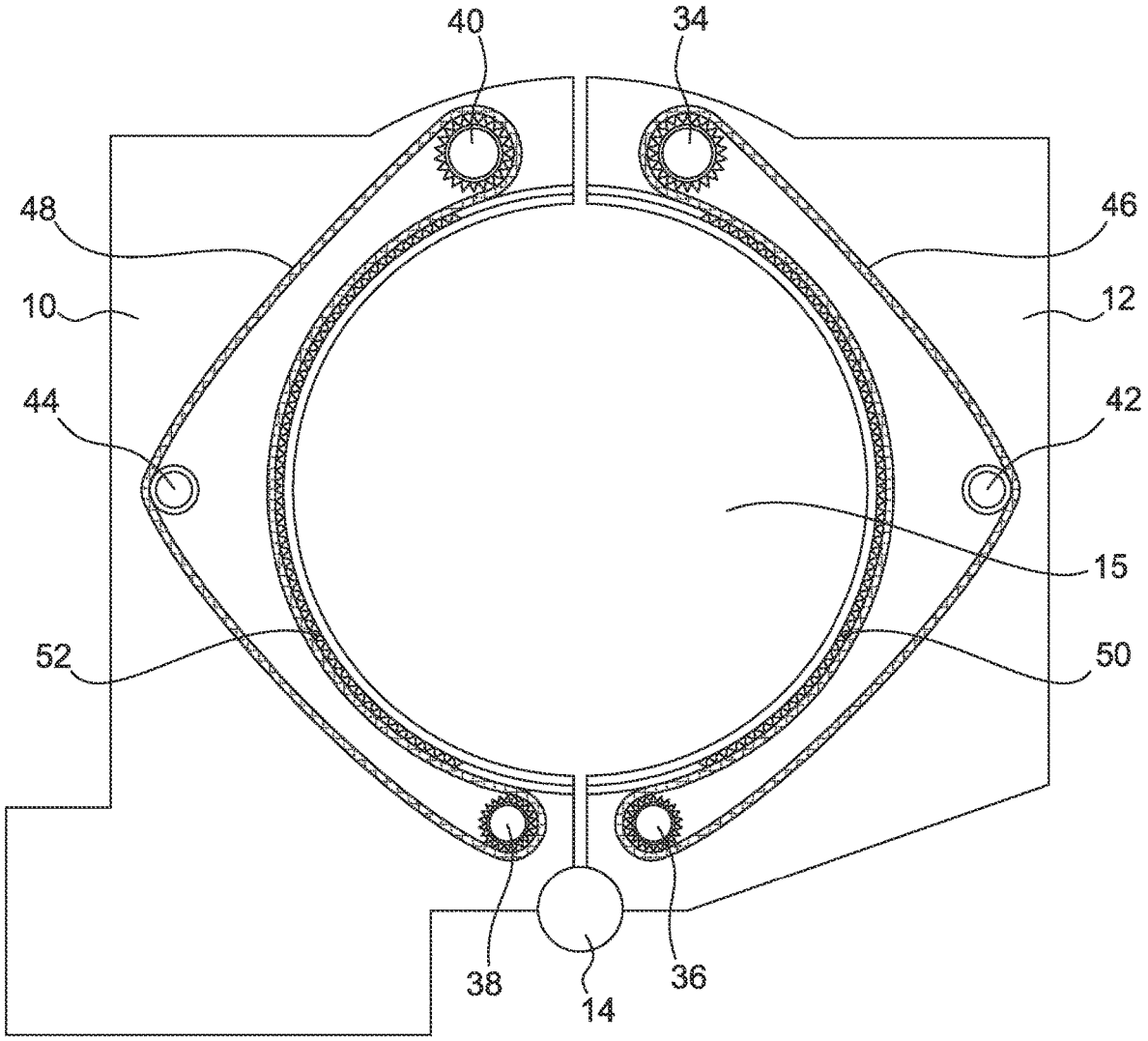
FIG. 4 is a view from below hollow boring auger of FIGS. 1 to 3, in the closed state, illustrating the rotating bearing mechanism.

Referring to FIGS. 1 to 4, a preferred embodiment of the invention will be described, where hollow boring auger apparatus 1 has first part 10 and second part 12, each with collar 13*a* and 13*b*, attached at hinge 14.

Hinge 14 is a strong pivot hinge, moveable between an open state and a closed state so as to be able to surround the base of the pole. The particular form of hinge 14 can be varied, to be suitable to move between the open and closed state. In the open state there is a gap between the open "jaws" of the first part 10 and the second part 12 to enable these "jaws" to surround the pole in use. The jaws close from the open state to the closed state to closely surround the circular perimeter of the pole. In the closed state first part 10 and second part 12 are closed together, which will enable the hollow to be dug as described below.

First part 10 and second part 12 are generally mirror images of one another internally, shaped to form a frame around the pole in use. Circular aperture 15 (refer FIG. 4) is formed when parts 10 and 12 are closed together. Circular aperture 15 is such that it has the dimensions very similar to a standard power pole or similar. Extension, companion plates or other plates can be used with the apparatus to increase or decrease the size of the circular aperture to match the diameter of the pole to be excavated. It is a key further inventive advantage to be able to vary the equipment readily to suit different sizes of pole without the need for different equipment sets. Once mounted on a vehicle, for example the equipment may be used continually to check multiple poles, even if these are of different diameters, without the need to remove the equipment from the vehicle to do so. Separately, where larger or smaller poles are used suitable sized spiral parts 22*a* and 22*b* can be used instead and attached to first part 10 and 12 by nuts and bolts as described below. In this way first part 10 and second part 12 can be used with a range of sizes of auger or spiral drills 22 to suit use for different diameter poles. The adaptability of the apparatus is a further significant advantage, for use with a single frame arrangement but different auger attachments.

As parts 10 and 12 surround the pole closely, the excavation dug around the base will be also be very close to the outer surface of a the pole, allowing close inspection of the base of the pole itself, and minimised dirt removal. Parts 10 and 12 are shown made of a strong steel as is suitable to the application. Other materials could be used instead such as other metals or a combination of suitable materials.

Collars 13*a* and 13*b* extend up to surround more of the pole. Collars 13*a* and 13*b* are beneficial in the circumstance where the excavation does reveal that a pole is rotten or otherwise undermined. The excavation around the base of the pole could lead to instability where the pole is weak. To act against loss of stability of the pole collar 13*a* and 13*b* surround the pole and assist to hold it strongly in the grip of the vehicle. As shown collar 13*a* and 13*b* are short. However, a taller collar would be most beneficial to assist to support the pole during the excavation process. Quite extended collars are also envisaged as part of the invention for use with poles at a high risk of underlying damage and instability.

Hydraulic ram 16 is used to open and close first part 10 and second part 12 about a pole (not shown throughout) at hinge 14. The opening and closing will be activated and controlled by the attached hydraulic device (not shown) via hydraulic pipes 18, as is particularly convenient. The hydraulic mechanism of a vehicle such as a digger is used to control hollow boring auger 1 and is connected in the usual manner. The hydraulic controls in the cab of the vehicle are used to open and close parts 10 and 12 around a pole. Use of hydraulic controls are known as simple control mechanisms such as for scooping or tipping of buckets of diggers. Other methods of opening and closing could be used instead, such mechanical pulleys, or electric actuators.

Shaft 20 attaches hollow boring auger device 1 to the vehicle before use, in the same manner as buckets or excavators. Shaft 20 provides support to move and manipulate hollow boring auger 1 to be positioned at the base of the pole before use, in the usual fashion. Once positioned at the base of the pole the jaws can be controlled by the digger operator, using hydraulic ram 16 so the base of the pole is surround. The hydraulic controls are usually associated with the support shaft to protect them from damage during use.

Spiral drill 22 can be seen to be formed in two parts 22*a* and 22*b* to surround the pole. Each of parts 22*a* and 22*b* of spiral 22 together each have back plate 24 and blade 26, which together form spiral drill 22, until end 28. End 28 is shaped to assist spiral 22 cutting into the ground on activation of the rotation mechanism.

Attachment plates 30 are used to attach parts 22*a* and 22*b* or spiral drill 22 to first part 10 and second part 12 respectively. Numerous nut and bolt arrangements, together labelled 32, effect the attachment between parts 10 and 12 to the spiral drill parts 22*a* and 22*b*. Attachment can occur during manufacturer, or where the parts are supplied separately by the user. Attachment plates 30 are shown as a pair of strong steel semi-circular plates with steel nut and bolt attachments 32 to strongly attach the frame formed by first part 10 and 12 to spiral drill 22 formed of parts 22*a* and 22*b*. The connection of parts 10 and 12 to spiral drill parts 22*a* and 22*b* by attachment plates 30 and nut and bolt arrangements 32 forms a strong and functional auger, about the pole. Auger apparatus 1 is now ready for use to excavate or bore the soil around the base of the pole.

Important to the invention is the rotation mechanism that rotates spiral drill 22 relative to the frame, formed by parts 10 and 12, to dig the hole. As can be seen in particular in FIG. 4, sprockets 34, 36, 38 and 40 are included with idler gears 42 and 44. Chains 46 and 48 are looped with sprockets 34 and 36, and 38 and 40 and corresponding idler gears 42 and 44 within each loop. Toothed sections 50 and 52 on spiral drill parts 22*a* and 22*b* respectively correspond and cooperate with the each within chains 46 and 48. On operation of hydraulic motors 54 and 56 chains 46 and 48 are moved by sprockets 34, 36, rotating, and in turn sprockets 38 and 40, and the chain around idler gears 42 and 44. In turn the toothed sections 50 and 52 are caused to move whereby the attached spiral drill or auger 22 rotates. In this way the earth is cut into by end 28 and a hole bored around the base of the pole. Hydraulic motors 54 and 56 are controlled from the cabin of the vehicle in the usual manner for hydraulic tools, eg off and on. More sophisticated control can also be made such as to control the speed of rotation depending on the activation of the hydraulics and can include reverse.

A further advance of the invention is the use of the new bearing arrangement for rotation of spiral 22. In this new bearing system one half of the bearing (chains 46 and 48) is attached to parts 10 and 12, the outer frame of the apparatus. The other half of the bearing (toothed parts 50 and 52) is attached to spiral 22 with oiled sprockets 34-38 between to run in the created track. The smooth rotation of spiral 22 is achieved readily through rotation of sprockets 34 and 40 turned by hydraulic motors 56 and 54 respectively. These turn chains 46 and 48, which catch on toothed regions 50 and 52 to correspondingly turn spiral 22 to dig into the ground. Idler gears 42 and 44 assist the smooth rotation and help to protect against loss of tension or problems with chains 46 and 48.

The invention includes several new and inventive features of great benefit. The open jaws allow the auger to surround the pole, the clever bearing mechanism rotates the auger in the closed state to dig a small neat hole which can then be readily filled in after inspection.

The clever invention solves a specific problem but has many applications. On use to dig around power poles and the like there will be a significant cost saving as the time and disturbance will be greatly reduced over the prior art.

It will be apparent to a person skilled in the art that changes may be made to the embodiment disclosed herein without departing from the spirit and scope of the invention in its various aspects.

REFERENCE SIGNS LIST

| | |
|---|---|
| 1 | Hollow Boring Auger |
| 10 | First Part |
| 12 | Second part |
| 13a/b | Collar |
| 14 | Hinge |
| 15 | Circular Aperture |
| 16 | Hydraulic ram |
| 18 | Hydraulic pipes |
| 20 | Shaft |
| 22a/b | Spiral |
| 24 | Back plate |
| 26 | Blade |
| 28 | Spiral end |
| 30 | Attachment plates |
| 32 | Nut and bolt arrangement |
| 34 | Sprocket |
| 36 | Sprocket |
| 38 | Sprocket |

-continued

| | |
|---|---|
| 40 | Sprocket |
| 42 | Idler gear |
| 44 | Idler gear |
| 46 | Chain |
| 48 | Chain |
| 50 | Toothed part |
| 52 | Toothed part |
| 54 | Hydraulic motor |
| 56 | Hydraulic motor |

The invention claimed is:

1. A hollow boring auger for use in boring a hollow trench about a pole, the hollow boring auger including:

a first mounting part and a second mounting part connected one to the other and movable between an open state and a closed state enabling the first and second mounting parts to be closed around the pole, encircling the pole, wherein the first mounting part and the second mounting part form an upper portion of the hollow boring auger;

a first auger part and a second auger part attachable to the first mounting part and second mounting part and forming in the closed state the hollow boring auger encircling the pole and projecting downwardly from the first and second mounting parts, wherein the first auger part and the second auger part form a lower portion of the hollow boring auger;

a first semi-circular attachment plate attachable between the corresponding first mounting part and the first auger part and a second semi-circular attachment plate attachable between the corresponding second mounting part and the second auger part, and once attached the opening and closing of the first mounting part and the first auger part, and the second mounting part and the second auger part, is together, so as to create jaws which can be closed about a base of the pole;

a rotation apparatus configured to rotate the auger about the pole to bore a hole, wherein the rotation apparatus is housed in the first and second mounting parts;

a cylindrical collar projecting upwardly from the first and second mounting parts and configured to encircle the pole in the closed state, wherein the collar extends at least 250 millimeters along a length of the pole, in use;

wherein the upper portion of the hollow boring auger and the lower portion of the hollow boring auger are removably attached to one another by fixings via the first semi-circular attachment plate and the second semi-circular attachment plate.

2. The hollow boring auger according to claim 1, wherein each of the first mounting part and the second mounting part include a semi-circular part such that the first mounting part and second mounting part in the closed state form a circular aperture to closely surround a circular perimeter of the pole.

3. The hollow boring auger according to claim 1, wherein the first mounting part and the second mounting part are hinged together to form jaws.

4. The hollow boring auger according to claim 1, wherein the first mounting part and the second mounting part are attached to a hydraulics system of an attached vehicle and the opening and closing of the first mounting part and the second mounting part is controlled from a cabin of the attached vehicle.

5. The hollow boring auger according to claim 1, wherein once attached together moving between the open and closed state of the first mounting part and second mounting part will also open and close the first auger part and the second auger part together.

6. The hollow boring auger according to claim 1, wherein the rotation apparatus includes a composite bearing arrangement adapted to enable rotation of the first auger part and the second auger parts together.

7. The hollow boring auger according to claim 6, wherein the composite bearing arrangement is included between the first mounting part and the first auger part, the composite bearing arrangement including a pair of sprockets within a chain arranged so that rotation of at least one of the sprockets translates to rotation of the chain, which in turn is translated to rotation of the first auger part by a cooperating portion on the first auger part.

8. The hollow boring auger according to claim 7, wherein the cooperating portion is a toothed portion on the first auger part that is caused to rotate due to cooperation with a proximal section of chain, when it is also rotating and there is a second sprocket, and the at least one of the sprockets and the second sprocket define an outer perimeter of an opening for the pole.

9. The hollow boring auger according to claim 6, wherein the composite bearing arrangement is included between the second mounting part and the second auger part, the composite bearing arrangement including a pair of sprockets within a chain arranged so that rotation of at least one of the sprockets translates to rotation of the chain, which in turn is translated to rotation of the second auger part by a cooperating portion on the second auger part and the cooperating portion is a toothed portion on the second auger part that is caused to rotate due to cooperation with a proximal section of chain, when it is also rotating.

10. The hollow boring auger according to claim 1, wherein the rotation apparatus includes one or more hydraulic motors, and as the hydraulic motors are operated corresponding sprockets rotate so as to rotate chains between a pair of sprockets associated with that chain, causing the associated coordinating part of the auger part to rotate together with the other auger part to bore the hollow trench.

11. The hollow boring auger according to claim 1, wherein the mounting parts form a frame for attachment of a drive mechanism of a vehicle and the auger parts rotate within the frame, in use.

12. The hollow boring auger according to claim 1, wherein the hollow trench is dug around a base of the pole by the auger so that there is minimum effort and disturbance to surrounding ground.

13. The hollow boring auger according to claim 1, wherein the first mounting part and the second mounting part are used with more than one size of first and second auger parts for digging holes of different diameters.

14. The hollow boring auger according to claim 1, wherein companion plates are attached to the mounting parts and/ or auger parts.

15. The hollow boring auger according to claim 1, wherein the fixings are nut and bolt arrangements.

16. A method of using a hollow boring auger, the hollow boring auger including a first mounting part and a second mounting part connected one to the other and movable between an open state and a closed state enabling the first and second mounting parts to be closed around a pole, encircling the pole, wherein the first mounting part and the second mounting part form an upper portion of the hollow boring auger, the first and second mounting parts attached correspondingly to a first auger part and a second auger part forming in the closed state the hollow boring auger circling the pole and projecting downwardly from the first and second mounting parts, wherein the first auger part and the second auger part form a lower portion of the hollow boring auger, and a first semi-circular attachment plate attachable between the corresponding first mounting part and the first auger part and a second semi-circular attachment plate attachable between the corresponding second mounting part and the second auger part, and once attached the opening and closing of the first mounting part and the first auger part, and the second mounting part and the second auger part is together, so as to create jaws which can be closed about a base of the pole, wherein the upper portion of the hollow boring auger and the lower portion of the hollow boring auger are removably attached to one another by fixings via the first semi-circular attachment plate and the second semi-circular attachment plate, the method including the following steps:

a. positioning the attached first mounting part and first auger part and second mounting part and second auger part close to a base of the pole;

b. closing jaws created by the first mounting part, first auger part, and the attached second mounting part and second auger part, about the base of the pole; and c. operating a rotation apparatus whereby the first and second auger parts rotate to create a hollow trench, about the base of the pole, wherein the rotation apparatus is housed in the first and second mounting parts, and wherein a cylindrical collar of the hollow boring auger projects upwardly from the first and second mounting parts and is configured to encircle the pole in the closed state, and wherein the collar extends at least 250 millimeters along a length of the pole, in use.

17. The method of claim 16, wherein the fixings are nut and bolt arrangements.

* * * * *